US008336648B1

(12) United States Patent
Weaver et al.

(10) Patent No.: US 8,336,648 B1
(45) Date of Patent: Dec. 25, 2012

(54) MECHANICAL ATTACHMENT OF THERMALLY STABLE DIAMOND TO A SUBSTRATE

(75) Inventors: Gary E. Weaver, Conroe, TX (US); Seth G. Anderle, Spring, TX (US); Ram L. Ladi, Tomball, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 13/225,214

(22) Filed: Sep. 2, 2011

(51) Int. Cl.

| | |
|---|---|
| ***E21B 10/00*** | (2006.01) |
| ***E21B 10/62*** | (2006.01) |
| ***E21B 10/627*** | (2006.01) |
| ***E21B 10/633*** | (2006.01) |

(52) U.S. Cl. ..... 175/412; 175/413; 175/420.2; 175/426; 175/432; 175/434

(58) Field of Classification Search ..... 175/412, 175/413, 420.2, 426, 432, 434, 383; 76/108.1, 76/108.2, 108.4, 108.6
See application file for complete search history.

(56) References Cited

U.S. PATENT DOCUMENTS

| | | | | |
|---|---|---|---|---|
| 3,932,952 | A * | 1/1976 | Helton et al. | 37/460 |
| 4,098,362 | A | 7/1978 | Bonnice | 175/329 |
| 4,224,380 | A | 9/1980 | Bovenkerk et al. | 428/545 |
| 4,225,322 | A | 9/1980 | Knemeyer | 51/295 |
| 4,602,691 | A | 7/1986 | Weaver | 175/329 |
| 4,605,157 | A * | 8/1986 | Barr et al. | 228/132 |
| 4,605,343 | A * | 8/1986 | Hibbs et al. | 407/119 |
| 4,629,373 | A | 12/1986 | Hall | 407/118 |
| 4,780,274 | A | 10/1988 | Barr | 418/7 |
| 4,850,523 | A | 7/1989 | Slutz | 228/121 |
| 6,109,377 | A * | 8/2000 | Massa et al. | 175/417 |
| 6,283,234 | B1 * | 9/2001 | Torbet | 175/432 |
| 6,510,906 | B1 | 1/2003 | Richert et al. | 175/39 |
| 6,544,308 | B2 | 4/2003 | Griffin et al. | 51/309 |
| 6,843,333 | B2 | 1/2005 | Richert et al. | 175/379 |
| 7,487,849 | B2 | 2/2009 | Radtke | 175/434 |
| 7,533,740 | B2 | 5/2009 | Zhang et al. | 175/432 |
| 7,712,553 | B2 | 5/2010 | Shamburger | 175/374 |
| 7,730,976 | B2 | 6/2010 | McClain et al. | 175/431 |
| 2006/0060392 | A1 | 3/2006 | Eyre | 175/434 |
| 2007/0082229 | A1 | 4/2007 | Mirchandani et al. | 428/698 |
| 2007/0278017 | A1 * | 12/2007 | Shen et al. | 175/426 |
| 2010/0230173 | A1 * | 9/2010 | Xia et al. | 175/374 |

OTHER PUBLICATIONS

U.S. Appl. No. 13/168,733; Ram L. Ladi et al.; pp. 41, Jun. 24, 2011.

* cited by examiner

*Primary Examiner* — Cathleen Hutchins
(74) *Attorney, Agent, or Firm* — Baker Botts L.L.P.

(57) ABSTRACT

The present disclosure provides mechanical attachments of TSD body to a carrier or substrate sufficient to allow eventual conventional attachment of the TSD to a drill bit or other component. According to one aspect, the disclosure includes a composite assembly including a thermally stable diamond (TSD) body and a substrate with aligned holes and a joining pin located in the aligned holes to mechanically attach the TSD body and substrate. The composite assembly may lack any non-mechanical attachment between the TSD body and the substrate, or may lack particular types of non-mechanical attachments. The disclosure also provides drill bits and other devices containing such composite assemblies as well as methods of making such composite assemblies and drill bits or other devices.

86 Claims, 4 Drawing Sheets

MECHANICAL ATTACHMENT OF THERMALLY STABLE DIAMOND TO A SUBSTRATE

TECHNICAL FIELD

The current disclosure relates to the mechanical attachment of thermally stable polycrystalline diamond to a carrier or substrate. This mechanical attachment may be sufficient to allow the ultimate attachment of the thermally stable polycrystalline diamond to a drill bit or other component using conventional attachment methods, such as brazing.

BACKGROUND

Components of various industrial devices are often subjected to extreme conditions, such as high impact contact with abrasive surfaces. For example, such extreme conditions are commonly encountered during subterranean drilling for oil extraction or mining purposes. Diamond, with its unsurpassed wear resistance, is the most effective material for earth drilling and similar activities that subject components to extreme conditions. Diamond is exceptionally hard, conducts heat away from the point of contact with the abrasive surface, and may provide other benefits in such conditions.

Diamond in its polycrystalline form has added toughness as compared to single crystal diamond due to the random distribution of the diamond crystals, which avoids the particular planes of cleavage found in single diamond crystals. Therefore, polycrystalline diamond is frequently the preferred form of diamond in many drilling applications or other extreme conditions. A drill bit that utilizes this material is referred to as a PDC (Polycrystalline Diamond Cutter) bit. Polycrystalline diamond can be manufactured in a press by subjecting small grains of diamond and other starting materials to ultrahigh pressure and temperature conditions.

The manufacturing process for a traditional PDC is very exacting and expensive. The process is referred to as "growing" polycrystalline diamond directly onto a carbide substrate to form a polycrystalline diamond composite compact. The process involves placing a cemented carbide piece and diamond grains mixed with a catalyst binder into a container of a press and subjecting it to a press cycle using ultrahigh pressure and temperature conditions. The ultrahigh temperature and pressure are required for the small diamond grains to form into an integral polycrystalline diamond body. The resulting polycrystalline diamond body is also intimately bonded to the carbide piece, resulting in a composite compact in the form of a layer of polycrystalline diamond intimately bonded to a carbide substrate.

The composite compact allows the attachment of the polycrystalline diamond body to other materials via attachment of the bonded carbide substrate to those materials. Unlike polycrystalline diamond, carbide may be easily attached to other materials via conventional methods, such as soldering and brazing. These methods may be performed at relatively low temperatures at which the polycrystalline diamond portion of the composite compact remains stable.

A problem with polycrystalline diamond composite compacts arises from the use of cobalt or other metal catalyst/binder systems to facilitate polycrystalline diamond growth. After crystalline growth is complete, the catalyst/binder remains within pores of the polycrystalline structure. Because cobalt or other metal catalyst/binders have a higher coefficient of thermal expansion than diamond, when the composite compact is heated, e.g., during the brazing process by which the carbide portion is attached to another material, or during actual use, the metal catalyst/binder expands at a higher rate than the diamond. As a result, when the composite compact is subjected to temperatures above a critical level, the expanding catalyst/binder causes fractures throughout the polycrystalline diamond structure. These fractures weaken the polycrystalline diamond body and can ultimately lead to damage to or failure of the composite compact.

Today's polycrystalline diamond material is designed to withstand temperatures at which composite compacts in the form of cutters are brazed to a drill bit (even multiple times), but as bits have been improved and used to drill harder and more abrasive formations, the temperature at the working face of a cutter can significantly exceed the critical temperature.

A new generation of polycrystalline diamond has been developed that utilizes a leached zone of diamond at the working face of the cutter. The majority of the catalyst/binder in this zone has been depleted, most often by acid leaching methods. Examples of current leaching methods are provided in U.S. Pat. No. 4,224,380, U.S. Pat. No. 7,712,553, U.S. Pat. No. 6,544,308, U.S. 20060060392 and related patents or applications. This process renders the polycrystalline diamond body more thermally stable in the leached zone while leaving the remainder of the body to provide attachment to the carbide substrate. Fully leached bodies (referred to hereafter as "thermally stable diamond" or "TSD") may also be created using these processes. However, such bodies lack a carbide substrate, making it difficult to attach them to other components. After the metal catalyst/binder has been removed from polycrystalline diamond to form TSD, the material is relatively non-wettable and its surface does not readily attach or adhere to other materials.

As a result of difficulties in attachment, attempts have been made to mechanically attach TSD bodies to substrates or bits. TSD bodies have previously primarily been used for surface set drill bits, where cutters made from the TSD bodies are generally small and may be embedded into the bit body by more than 50% to effect a mechanical "lock." One such system is described in U.S. Pat. No. 4,602,691. These and other mechanical locking methods are described in U.S. Pat. No. 7,533,740, U.S. Pat. No. 4,780,274, U.S. Pat. No. 4,629,373 and related patents or applications, but such methods are prone to failure.

For instance, in U.S. Pat. No. 4,780,274, holes in a TSD body were filled with bit matrix. However, due to the low wetting capacity of TSD, the TSD elements were not effectively held by the bit matrix. Furthermore, because the bit body lacks the mechanical strength of cemented carbide or other substrate materials, TSD elements attached to a bit as disclosed in U.S. Pat. No. 4,780,274 are prone to failure under high load or impact.

Similarly, U.S. Pat. No. 4,629,373 discloses a TSD body with surface irregularities that are used in an attempt to mechanically lock the TSD to a substrate. However, the surface irregularities in U.S. Pat. No. 4,629,373 are not sufficient to achieve permanent attachment of the TSD and a substrate because the non-attachability of diamond to other materials is not overcome.

Other techniques seeking to avoid reliance on such mechanical trapping have centered around enhancements to the surface of the TSD that enable it to be brazed to a carbide substrate or carrier in much the same way a traditional polycrystalline diamond composite compact cutter is brazed to a bit. Example brazing methods are described in described in U.S. Pat. No. 4,850,523, U.S. Pat. No. 7,487,849, U.S. Pat. No. 4,225,322 and related patents or applications. Although some level of success has been reported with such techniques, commercial products employing them are not yet available.

Accordingly a need exists for methods of reliably attaching TSD to a substrate, in particular a substrate that will allow the ultimate attachment of the TSD via conventional methods such as brazing or soldering to drill bits or other components used in extreme conditions where TSD is beneficial.

SUMMARY

The present invention provides for mechanical attachment of a TSD body to a carrier or substrate sufficient to allow eventual conventional attachment of the TSD to a drill bit or other component.

According to one aspect, the invention includes a composite assembly including a thermally stable diamond (TSD) body having at least one TSD body hole disposed therein. The hole may reach from a top surface of the TSD body to a bottom surface of the TSD body. The composite assembly also includes a substrate having at least one substrate hole disposed therein, the substrate hole being located so as to align with the TSD body hole, and at least one joining pin disposed in the TSD body hole and the substrate hole to mechanically attach the TSD body to the substrate to form a composite assembly. In some embodiments, the composite assembly may lack any non-mechanical attachment between the TSD body and the substrate or may lack certain types of non-mechanical attachments.

According to a second aspect, the invention includes a drill bit including a bit body and a composite assembly according to the first aspect.

According to a third aspect, the invention includes a method of forming a composite assembly. The method includes forming at least one hole in a thermally stable diamond (TSD) body. The hole may reach from a top surface of the TSD body to a bottom surface of the TSD body. The method also includes forming at least one hole in a substrate. The hole may align with the hole in the TSD body when the composite assembly is formed. The method further includes attaching at least one joining pin to the substrate via the at least one hole in the substrate, then placing the at least one joining pin the at least one hole in the TSD body to mechanically attach the TSD body to the substrate to form a composite assembly in which the TSD body and substrate are held together in the composite assembly in the absence of any non-mechanical attachment therebetween.

According to a forth aspect, the invention includes another method of forming a composite assembly. This method includes forming at least one hole in a thermally stable diamond (TSD) body, which may reach from a top surface of the TSD body to a bottom surface of the TSD body, placing at least one joining pin in the hole in the TSD body, placing the TSD body and joining pin in a mold, placing a matrix powder in the mold on the TSD body and infiltrating the matrix powder and the at least one joining pin with an infiltration material to form a substrate attached to the joining pin and mechanically attached to the TSD body in a composite assembly.

According to a fifth aspect, the invention includes yet another method of forming a composite assembly. This method includes forming at least one hole in a thermally stable diamond (TSD) body, which may reach from a top surface of the TSD body to a bottom surface of the TSD body, forming at least one hole in a substrate, which may align with the hole in the TSD body after the composite assembly is formed, placing at least one joining pin in the hole in the TSD body and in the hole in the substrate to form a TSD body/substrate/joining pin assembly, placing a shim of alloy material in the bottom of a mold, placing the TSD body/substrate/joining pin assembly on the alloy material in the mold, and heating the mold to a brazing temperature such that the braze alloy melts, wicks up the sides of the joining pin and bonds the pin to the substrate.

According to a sixth aspect, the invention includes a method of forming a drill bit. The method includes casting a substrate or substrate-like support in a bit body of the drill bit during formation of the bit body by a matrix infiltration process, forming at least one hole in the substrate or substrate-like support, the hole being located so as to align with a TSD body hole to form a composite assembly, forming at least one hole in a thermally stable diamond (TSD) body, wherein the hole may reach from a top surface of the TSD body to a bottom surface of the TSD body, attaching at least one joining pin to the substrate or substrate-like support via the at least one hole in the substrate or substrate-like support, and placing the at least one joining pin the at least one hole in the TSD body to mechanically attach the TSD body to the substrate or substrate-like support to form a composite assembly on the bit body in which the TSD body and substrate are held together in the composite assembly in the absence of any non-mechanical attachment therebetween.

BRIEF DESCRIPTION OF THE DRAWINGS

A more complete understanding of the present embodiments and advantages thereof may be acquired by referring to the following description taken in conjunction with the accompanying drawings, which describe particular embodiments of the disclosure, in which like numbers refer to similar components, and in which.

DETAILED DESCRIPTION

The current disclosure provides a composite assembly including a TSD body mechanically attached to a carrier or substrate (which may also be referred to herein as simply a "carrier" or a "substrate"). The disclosure also provides methods of mechanically attaching a TSD body to a carrier or substrate to form a composite assembly. Attachment of the TSD body to a carrier or substrate may be sufficient to allow eventual conventional attachment of the TSD body to a drill bit or other component via the carrier or substrate of the composite assembly. The disclosure also includes drill bits including carrier assemblies and methods of forming such bits.

According to specific embodiments, the TSD body may be attached to the substrate by mechanical techniques that do not require adhesives, glue, brazes or welds between the substrate and the TSD body. Joining pins such as nails or rivets may be used to mechanically latch the two pieces together. "Joining pins" and "joining pin" as used herein may refer to one pin or multiple pins. The appropriate number of pins to be used in a given composite assembly may be determined by one of ordinary skill in the art using the disclosure contained herein. In selected embodiments, in addition to the mechanical attachment provided by joining pins, the TSD body and the substrate may also be non-mechanically attached, for instance by an infiltrant material. Regardless of whether any non-mechanical attachments are also present, the joining pins may provide sufficient mechanical attachment between the TSD and the substrate such that non-mechanical attachment between the two pieces is not necessary. The joining pins may be fixed to the TSD and substrate in various manners described in the following exemplary embodiments.

Figure 2:
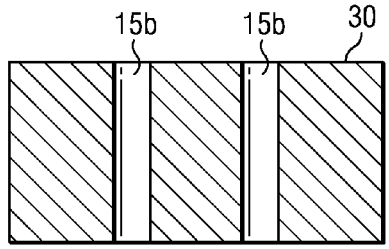
FIG. 2 depicts a substrate with corresponding holes that may align with holes of the TSD body shown in FIG. 1.
Figure 3:
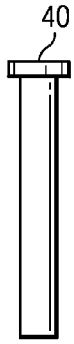
FIG. 3 depicts a joining pin that may be used to attach the TSD body of FIG. 1 to the substrate of FIG. 2.
Figure 4:
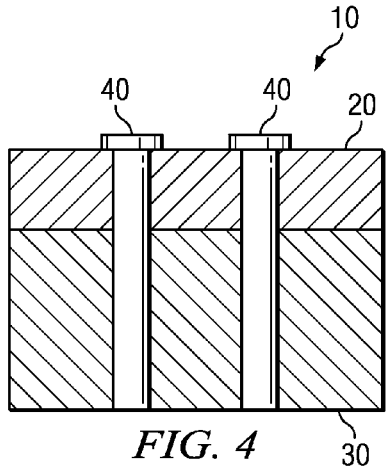
FIG. 4 depicts an composite assembly in the form of a cutter including a TSD body and substrate.

According to a first embodiment described in FIGS. 1-4, the disclosure provides a composite assembly (10) as shown in FIG. 4. Composite assembly (10) may be produced from the components shown in FIGS. 1-3.

Figure 1A:
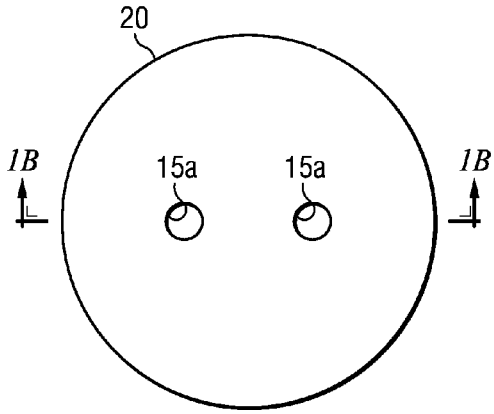
FIGS. 1A and 1B depict two views of a solid TSD body with holes penetrating from the top surface through TSD body to the bottom surface.
Figure 1B:
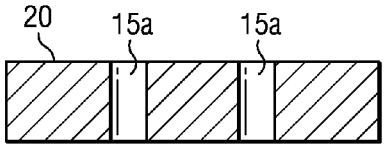
Figure 1C:
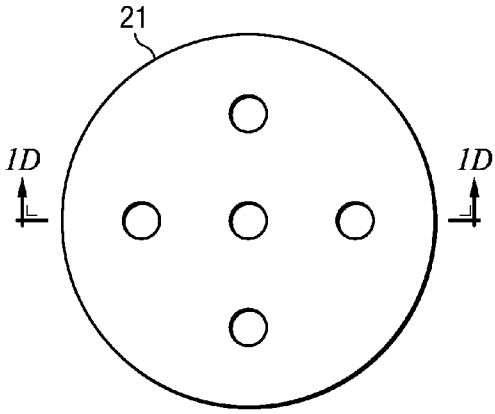
FIGS. 1C and 1D depict two views of an alternate solid TSD body with holes penetrating from the top surface through TSD body to the bottom surface.
Figure 1D:
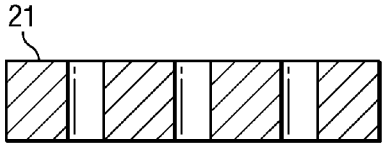

FIGS. 1A and 1B depict two views of a solid TSD body (20) with holes (15*a*) penetrating from the top surface through TSD body (20) to the bottom surface. FIGS. 1C and 1D depict two views of an alternative solid TSD body (21) with holes (15*a*) penetrating from the top surface through TSD body (21) to the bottom surface. In more specific embodiments, such holes may be similar to those disclosed in U.S. Pat. No. 4,780,274, incorporated in material part by reference herein, particularly FIGS. 8 and 9 thereof. Although the holes in U.S. Pat. No. 4,780,274 were used for attachment of TSD directly to a bit, they may be adapted according to the disclosure herein to allow attachment to a substrate.

Holes (15*a*) may be formed during the initial polycrystalline diamond growing process by the use of tungsten carbide or other extensions from the initial substrate on which the polycrystalline diamond is formed. This tungsten carbide or other material may later be removed during the leaching process used to convert the polycrystalline diamond to TSD.

Alternatively, holes (15*a*) may be formed by electric discharge machining (also called "EDM") or by laser cutting.

TSD may be produced by any conventionally available methods. For example, it may be produced by the methods described in U.S. Pat. No. 4,224,380, U.S. Pat. No. 7,712,553, U.S. Pat. No. 6,544,308, or U.S. 20060060392 and related patents or applications, incorporated in material part by reference herein.

An alternative leaching method using a Lewis acid-based leaching agent may also be employed. In such a method, the PCD containing catalyst may be placed in the Lewis acid-based leaching agent until the desired amount of catalyst has been removed. This method may be conducted at lower temperature and pressure than traditional leaching methods. The Lewis acid-based leaching agent may include ferric chloride ($FeCl_3$), cupric chloride ($CuCl_2$), and optionally hydrochloric acid (HCl), or nitric acid ($HNO_3$), solutions thereof, and combinations thereof. An example of such a leaching method may be found in U.S. Ser. No. 13/168,733 by Ram Ladi et al., filed Jun. 24, 2011, and titled "CHEMICAL AGENTS FOR LEACHING POLYCRYSTALLINE DIAMOND ELEMENTS," incorporated by reference in its entirety herein.

In particular embodiments, the TSD body (20) may have a higher diamond density that is typically used in traditional polycrystalline diamond elements because such diamond densities will not interfere with attachment of the TSD body (20) to the substrate (30) or with the formation of a adequately leached element.

FIG. 2 depicts substrate (30) with corresponding holes (15*b*) that align with holes (15*a*) of TSD body (20). The substrate (30) may be made of any high strength material. According to one embodiment, it may include other carbide-containing materials, tungsten (W), tungsten carbide (WC or $W_2C$), including cemented tungsten carbide, chromium (Cr), iron (Fe), nickel (Ni), other materials able to increase erosion resistance of the substrate. According to more particular embodiments, the substrate may include one or more of the above materials. According to one embodiment, it may primarily include tungsten carbide.

FIG. 3 depicts a joining pin (40) used to attach the TSD body (20) to the substrate (30). Joining pin (40) may include any material described above as suitable for inclusion in substrate (30). According to particular embodiments, joining pin (40) may include cemented tungsten carbide. According to other particular embodiments, joining pin (40) may have a coefficient of thermal expansion similar to that of diamond in order to minimize stress on TSD body (20) due to thermal expansion of joining pin (40). For instance it may be made primarily of tungsten carbide. Joining pin (40) may also be selected to have a high abrasion resistance to prevent undue wear of portions of joining pin (40) on the face of composite assembly (10). In some embodiments, joining pin (40) may be made of a softer material, such as steel, with a cap or top coating of harder material, such as cemented tungsten carbide. In some such embodiments, joining pin (40) may be formed in place.

FIG. 4 shows a composite assembly (10) in the form of a cutter including TSD body (20) and substrate (30). TSD body (20) and substrate (30) may be held together by joining pin (40). Composite assembly (10) may be assembled by attaching joining pins (40) to TSD body (20) then placing substrate (30) on the pins. Joining pins (40) may be attached to substrate (30) and TSD body (20) by any method sufficient for them to remain secure during normal use of the composite assembly. For instance, joining pins (40) may be attached by brazing, welding, pressing, or gluing. One apparatus capable of forming the composite assembly (10) is found in U.S. Pat. No. 4,225,322, (incorporated in material part by reference herein), particularly FIG. 2.

Figure 5:
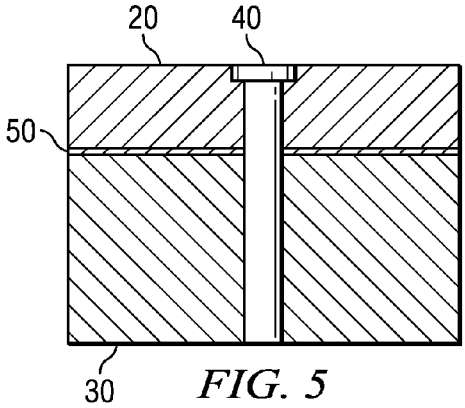
FIG. 5 depicts a TSD body that includes a counter bore into which a joining pin fits.

According to other embodiments, such as the example shown in FIG. 5, a dampening material (50) may also be placed between TSD body (20) and substrate (30) to provide improved joint construction. The dampening material may be soft enough to deform when attaching the TSD body (20) to the substrate (30), creating continuous contact with both the TSD body (20) and the substrate (30). This may prevent or decrease cyclic bending stresses on the TSD body (20) due to vibrations. Such bending stresses may cause the TSD body (20) to prematurely fail. The dampening material may also help absorb impact when composite assembly (10) contacts a surface. For instance, when composite assembly (10) is in the form of a cutter on a drill bit, the dampening material may help absorb the impact of the cutter contacting the formation being drilled. Furthermore, the dampening material may also aid in transferring heat from the TSD body (20) to the substrate (30) by increasing the amount of surface area effectively in contact between the two materials.

According to a particular embodiment, the dampening material may have a high coefficient of thermal conductivity, may be easily deformed, and may have a melting point higher than temperatures experienced during normal use of the composite assembly. For instance, the dampening material may primarily include a copper alloy. In some embodiments, it may include gold or silver.

FIG. 5 illustrates an alternative embodiment in which TSD body (20) includes a counter bore into which joining pin (40) fits. The face of TSD body (20) may be subjected to abrasion during use of composite assembly (10). For instance, when composite assembly (10) is in the form of a cutter and mounted on a drill bit, cuttings generated during drilling slide over the face of the cutter and abrade exposed portions of joining pin (40). Exposed portions of joining pin (40) may also be subjected to extreme erosion as a slurry containing highly abrasive particles is directed at a high velocity near the face of TSD body (20) in order to clean and cool TSD body (20). Because joining pin (40) is formed from a material with less abrasion resistance than TSD body (20), it will wear much faster than TSD body (20). This may cause the head of joining pin (40) to abrade or erode away, allowing TSD body (20) to detach from substrate (30), leading to failure of composite assembly (10). The presence of a counter bore helps prevent or decrease the occurrence of composite assembly failure due to erosion or abrasion of joining pin (40).

Figure 6:
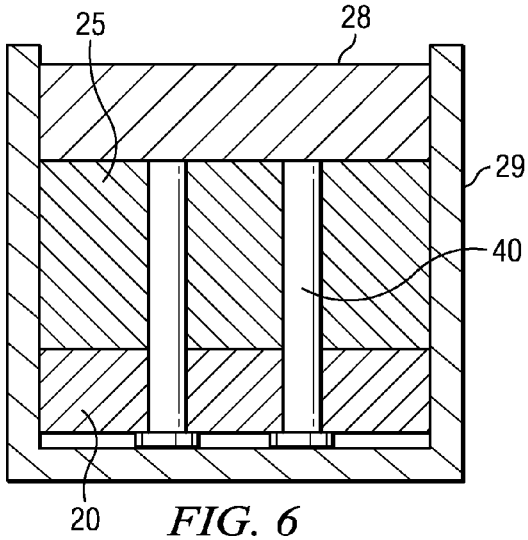
FIG. 6 depicts a mold assembly for forming a composite assembly.

According to a second embodiment, a composite assembly (10) as described in FIG. 4 may be produced in an alternative manner. TSD body (20), containing holes (15*a*) may be placed into a mold (29), such as a graphite mold, along with joining pins (40) as illustrated in FIG. 6. Substrate (30) may be formed around joining pins (40) by loading a matrix powder (25) on top of TSD body (20) in an amount sufficient to produce a desired volume of substrate (30). Infiltrant material (28) may then be placed onto the mold, which may then be heated to allow infiltration of the matrix powder (25) with the infiltrant material (28) to produce substrate (30) around joining pins (40). Embodiments of this process as well as other, related processes, such as hot press methods or other methods in which infiltrant material (28) may be mixed with matrix powder (25), all of which may be used in this embodiment, are disclosed in further detail in "ELEMENT CONTAINING THERMALLY STABLE POLYCRYSTALLINE DIAMOND MATERIAL AND METHODS AND ASSEMBLIES FOR FORMATION THEREOF," filed concurrently herewith and incorporated by reference in its entirety herein.

Figure 7:
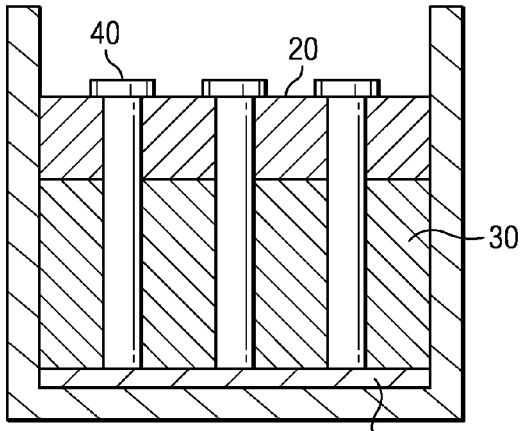
FIG. 7 depicts a mold assembly for forming a composite assembly containing a alloy material.

According to a third embodiment, a composite assembly (10) as described in FIG. 4 may be produced in another alternative manner. As shown in FIG. 7, a mold (29), such as a graphite mold, may be assembled with a shim of alloy material (27). An assembly of substrate (30) along with an alternate TSD body (21) and joining pin (40) may be placed in the mold (29) on top of the alloy material (27). This assembly may be heated to a sufficient temperature to allow the alloy material to melt and wick up the sides of the pins through capillary action and bond the pins to the substrate.

Alloy material (27) and any other alloy material described herein may, in some embodiments, be any type of material commonly used for attachment of the substrate portion of polycrystalline diamond compacts to other components, such as drill bits. The alloy material (27) may be provided in any form, but in particular embodiments it may be in the form of a thin foil. In particular embodiments it may include a Group VIII metal or copper (Cu), gold (Au), or silver (Ag).

Figure 8A:
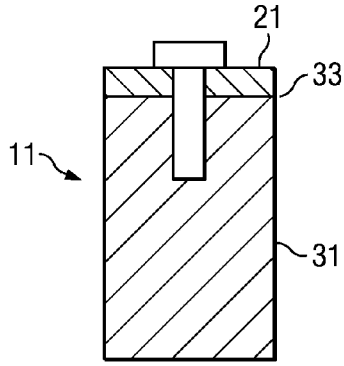
FIG. 8A depicts a composite assembly containing an alternate TSD body and a substrate.
Figure 8B:
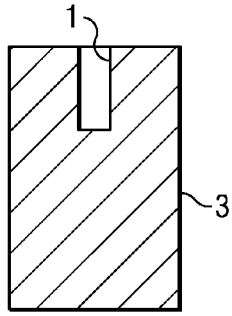
FIG. 8B depicts a substrate containing a blind hole.
Figure 8C:
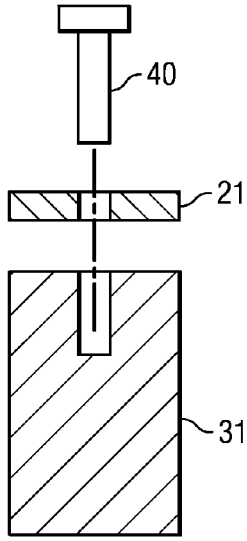
FIG. 8C depicts an exploded view of the composite assembly of FIG. 8A showing alternate TSD substrate, and joining pin.

FIGS. 8A-8C show a fourth embodiment, composite assembly (11). FIG. 8A illustrates composite assembly (11) containing alternate TSD body (21) and substrate (31). As shown in FIG. 8B, substrate (31) contains a single hole (16) that does not go completely through substrate (31). Such a hole is commonly referred to as a blind hole. FIG. 8C provides an exploded view of composite assembly (11) with alternate TSD body (21), substrate (31) and joining pin (40). In this embodiment, joining pin (40) may be attached to substrate (31) in any of the manners described for the first embodiment.

Figure 9:
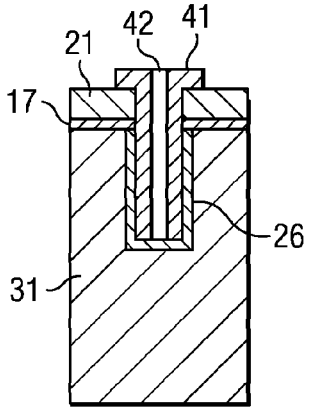
FIG. 9 depicts a composite assembly in which the joining pin contains a longitudinal hole.

According to a fifth embodiment, shown in FIG. 9, the substrate (31) may contain a blind hole as described in the fourth embodiment. However, in this embodiment joining pin (41) may have hole (42) along its longitudinal axis which extends the full length of the pin. This hole (42) may act as a vent for any gasses produced during any brazing process used to attach the joining pin (41) to the substrate (31). In one more specific embodiment as shown, attachment may be accomplished using alloy material (26) located along the length of joining pin (41) and between it and the walls of hole (42).

Figure 10:
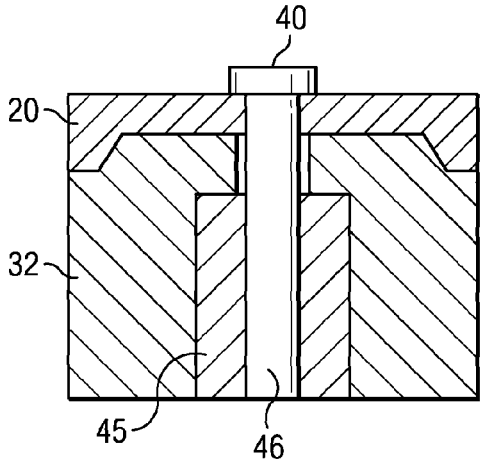
FIG. 10 depicts an alternative method of attaching a joining pin to a substrate.

According to a sixth embodiment, shown in FIG. 10, joining pins (40) may be attached to the substrate (32) in an alternative fashion. By utilizing a high strength steel alloy insert (45) in a corresponding recess of substrate (32), a joining pin (40) may be press-fitted or interference-fitted into a tolerance hole of steel alloy insert (45). In particular press-fitting and interference-fitting technology used in roller cone drill bits to attach tungsten carbide insert cutters to the rolling cones of three cone bits may be used. One example press-fitting technique is described in U.S. 4,098,362, incorporated in material part by reference herein. In other embodiments, this form of attachment may be similar to that used to attach PDC cutters to steel bits.

The composite assemblies of the present disclosure, such as those described in embodiments one to six may be in the form of a cutter for an earth-boring drill bit, such as a fixed cutter bit. In certain other embodiments the composite assemblies may be used in directing fluid flow or for erosion control in an earth-boring drill bit. For instance, they may be used in the place of abrasive structures described in U.S. Pat. No. 7,730,976, U.S. Pat. No. 6,510,906, or U.S. Pat. No. 6,843,333, each incorporated by reference herein in material part.

When used in a drill bit as cutters or for directing fluid flow or erosion control, composite assemblies may be attached to the bit body by brazing, soldering, press fitting, or other methods known in the art of drill bit manufacture. Composite assemblies may also be used in drill bits in place of other elements, such as bearings.

The composite assemblies of the present disclosure, such as those described in embodiments one to six, may also be used in other items containing polycrystalline diamond elements or other superabrasive elements, such as machine tools. In such embodiments, the composite assemblies may be attached using methods known for attachment of traditional polycrystalline diamond assemblies.

Figure 11:
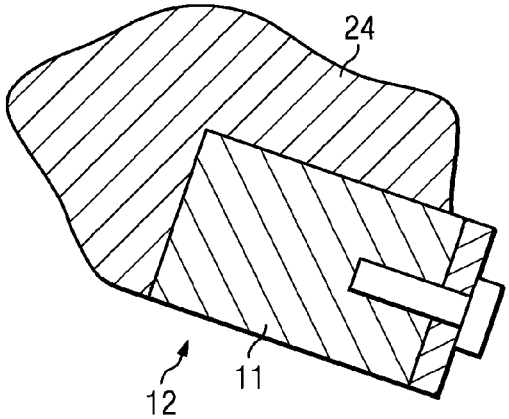
FIG. 11 depicts a composite assembly attached to a drill bit.
Figure 12:
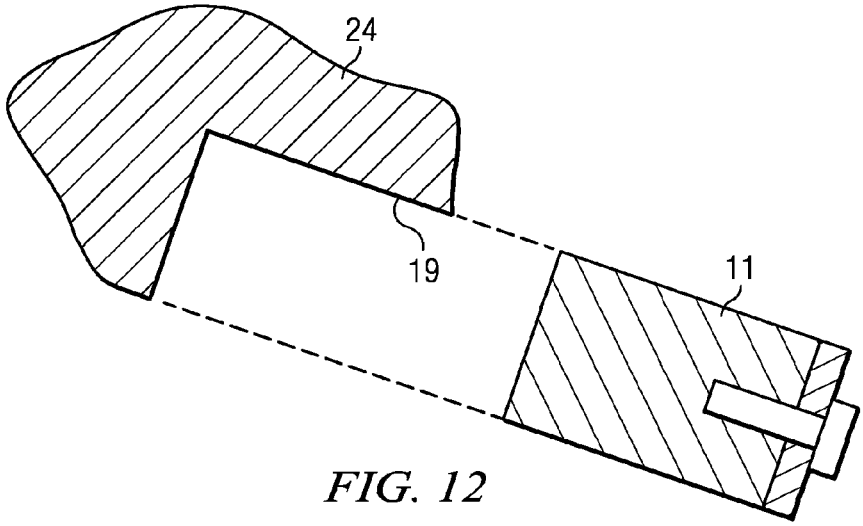
FIG. 12 depicts an exploded view of the composite assembly and drill bit of FIG. 11.

According to a seventh embodiment, FIG. 11 illustrates a composite assembly (12) attached to a drill bit (24). According to a particular embodiment, drill bit (24) may be an earth-boring drill bit, such as a fixed cutter drill bit. Composite assembly (12) may be a cutter. FIG. 12 shows an exploded view of composite assembly (12) and drill bit (24) also shown in FIG. 11. In FIG. 12, wall (19) of the cutter pocket into which the composite assembly cutter (12) may be fitted is depicted next to the composite assembly (12).

Figure 13A:
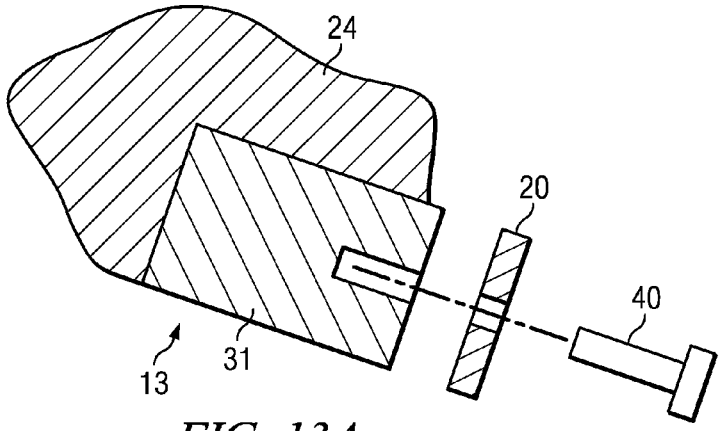
FIG. 13A depicts a composite assembly attached to drill bit in which the composite assembly includes a substrate cast directly on the bit body.

FIG. 13 illustrates two additional ways in which a composite assembly (12) may be attached to a drill bit (24). In FIG. 13A substrate (31) is attached to drill bit (24) as a result of being cast directly in place during the manufacture of the drill bit body, for example by a powder matrix infiltration process. Subsequently, a TSD body (20) and joining pins (40) are fitted to substrate (31) and the pins are brazed into place or otherwise attached to the substrate.

Figure 13B:
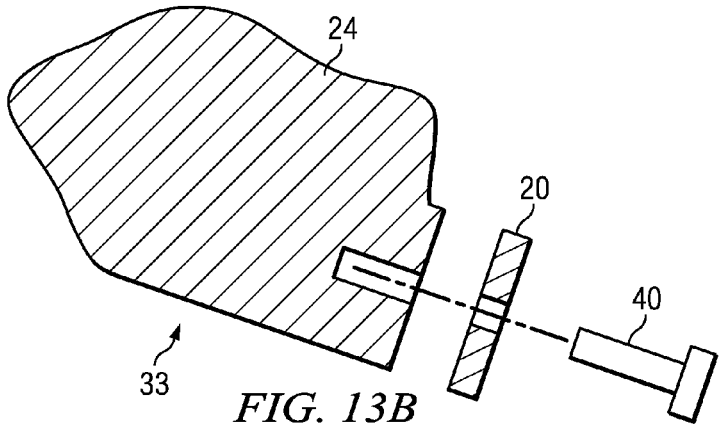
In FIG. 13B depicts a composite assembly attached to drill bit in which the composite assembly includes a substrate-like support cast directly on the bit body.

In FIG. 13B substrate-like support (33) may be formed as part of the body during formation of the drill bit, for example by a powder matrix infiltration process. In a subsequent process, TSD (20) and joining pins (40) are fitted to the substrate-like support (33) and the pins are brazed into place or otherwise attached to the substrate-like support. In this embodiment, the TSD is therefore directly attached to the bit without a substrate.

Figure 14A:
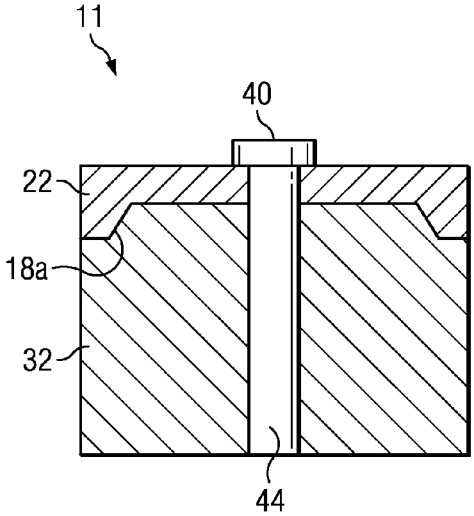
FIG. 14A depicts a composite assembly with an interlocking TSD and substrate.
Figure 14B:
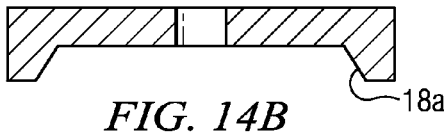
FIG. 14B depicts the TSD body in the composite assembly of FIG. 14A.
Figure 14C:
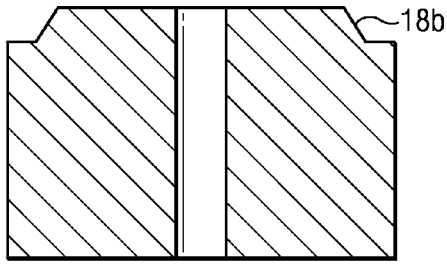
FIG. 14C depicts the substrate in the composite assembly of FIG. 14A.

According to an eighth embodiment, another composite assembly (11) with interlocking surfaces is shown in FIGS. 14A-14C. According to this embodiment, TSD body (22) has an interlocking surface (18*a*) formed between it and an interlocking surface (18*b*) of substrate (32). Interlocking surfaces 18*a* and 18*b* give TSD body (22) a non-planar conical section. When used in a cutter, this structure may provide additional strength to the composite assembly to resist shearing forces developed during drilling. Such shearing forces might otherwise cause the TSD body to delaminate from the substrate. In particular, in the absence of a non-planar conical section, joining pin (40) would bear the load of shearing forces. In the embodiment depicted, interlocking surfaces 18*a* and 18*b* bear all or part of that load. These surface also help the assembly resist lateral loading.

Interlocking surfaces 18*a* and 18*b* also help in assembly of the composite assembly (11) by facilitating alignment of the holes.

Although only exemplary embodiments of the invention are specifically described above, it will be appreciated that modifications and variations of these examples are possible without departing from the spirit and intended scope of the invention. For instance, specific embodiments in which composite assemblies are contained in drill bits as well as methods of forming such drill bits are described herein. One skilled in the art of making other devices containing polycrystalline diamond elements, such as machine tools, may adapt the devices and methods described herein for use with such other devices. Additionally, although generally planar TSD bodies are depicted in the figures, TSD bodies may take any shape. For instance, the TSD bodies may have thicker regions where high wear is expected, such as at the working surface.

The invention claimed is:

1. A composite assembly comprising:

a thermally stable diamond (TSD) body having at least one TSD body hole disposed therein, wherein the TSD body hole reaches from a top surface of the TSD body to a bottom surface of the TSD body;

a substrate having at least one substrate hole disposed therein, the substrate hole located so as to align with the TSD body hole;

at least one joining pin disposed in the TSD body hole and the substrate hole to mechanically latch the TSD body to the substrate to form the composite assembly; and a brazing material, a welding material, or a glue connecting the substrate hole and the joining pin.

2. The composite assembly according to claim 1, wherein catalyst has been removed from the TSD body using acid leaching.

3. The composite assembly according to claim 2, wherein the catalyst has been removed from the TSD body using $FeCl_3$ acid leaching.

4. The composite assembly according to claim 1, wherein the substrate comprises a material selected from the group consisting of: tungsten (W), tungsten carbide (WC or $W_2C$), other carbide-containing materials, chromium (Cr), iron (Fe), nickel (Ni), and combinations thereof.

5. The composite assembly according to claim 4, wherein the substrate comprises cemented tungsten carbide.

6. The composite assembly according to claim 1, wherein the joining pin comprises a material selected from the group consisting of: tungsten (W), tungsten carbide (WC or $W_2C$), other carbide-containing materials, chromium (Cr), iron (Fe), nickel (Ni), and combinations thereof.

7. The composite assembly according to claim 6, wherein the joining pin comprises cemented tungsten carbide.

8. The composite assembly according to claim 1, wherein at least one substrate hole comprises a blind hole.

9. The composite assembly according to claim 1, wherein at least one joining pin contains a joining pin hole located along a longitudinal axis and extending the full length of the pin.

10. The composite assembly according to claim 1, wherein the TSD body further comprises at least one counter bore in which the at least one joining pin is located.

11. The composite assembly according to claim 1, further comprising a dampening material located between the TSD body and the substrate.

12. The composite assembly according to claim 11, wherein the dampening material comprises a copper alloy, gold, or silver.

13. A drill bit comprising:

a bit body; and a composite assembly comprising:

a thermally stable diamond (TSD) body having at least one TSD body hole disposed therein, wherein the TSD body hole reaches from a top surface of the TSD body to a bottom surface of the TSD body;

a substrate having at least one substrate hole disposed therein, the substrate hole located so as to align with the TSD body hole;

at least one joining pin disposed in the TSD body hole and the substrate hole to mechanically latch the TSD body to the substrate to form the composite assembly; and a brazing material, a welding material, or a glue connecting the substrate hole and the joining pin.

14. The drill bit according to claim 13, wherein catalyst has been removed from the TSD body using acid leaching.

15. The composite assembly according to claim 14, wherein the catalyst has been removed from the TSD body using $FeCl_3$ acid leaching.

16. The drill bit according to claim 13, wherein the substrate comprises a material selected from the group consisting of: tungsten (W), tungsten carbide (WC or $W_2C$), other carbide-containing materials, chromium (Cr), iron (Fe), nickel (Ni), and combinations thereof.

17. The drill bit according to claim 16, wherein the substrate comprises cemented tungsten carbide.

18. The drill bit according to claim 13, wherein the joining pin comprises a material selected from the group consisting of: tungsten (W), tungsten carbide (WC or $W_2C$), other carbide-containing materials, chromium (Cr), iron (Fe), nickel (Ni), and combinations thereof.

19. The drill bit according to claim 18, wherein the joining pin comprises cemented tungsten carbide.

20. The drill bit according to claim 13, wherein at least one substrate hole comprises a blind hole.

21. The drill bit according to claim 13, wherein at least one joining pin contains a joining pin hole located along a longitudinal axis and extending the full length of the pin.

22. The drill bit according to claim 13, wherein the TSD body further comprises at least one counter bore in which the at least one joining pin is located.

23. The drill bit according to claim 13, further comprising a dampening material located between the TSD body and the substrate.

24. The drill bit according to claim 23, wherein the dampening material comprises a copper alloy, gold, or silver.

25. The drill bit according to claim 13, wherein the composite assembly is in the form of a bearing.

26. The drill bit according to claim 13, wherein the composite assembly is in the form of a cutter.

27. The drill bit according to claim 26, wherein the bit body comprises a cutter pocket in which the substrate of the composite assembly is attached.

28. The drill bit according to claim 27, further comprising a brazing material, a welding material, or a gluing material attaching the substrate of the cutter to the cutter pocket.

29. The drill bit according to claim 26, wherein the substrate comprises a substrate cast directly in the bit body.

30. The drill bit according to claim 26, wherein the substrate comprises a substrate-like base case directly in the bit body.

31. A method of forming a composite assembly comprising:

forming at least one hole in a thermally stable diamond (TSD) body, wherein the TSD body hole reaches from a top surface of the TSD body to a bottom surface of the TSD body;

forming at least one hole in a substrate, the substrate hole located so as to align with the TSD body hole when the composite assembly is formed;

attaching at least one joining pin to the substrate via the at least one hole in the substrate;

placing the at least one joining pin in the at least one hole in the TSD body and in the at least one hole in the substrate and brazing, welding, gluing or pressing the pin into the hole in the substrate to mechanically latch the TSD body to the substrate to form a composite assembly in which the TSD body and substrate are held together in the composite assembly in the absence of any non-mechanical attachment therebetween.

32. The method according to claim 31, further comprising forming the TSD body by acid-leaching catalyst from polycrystalline diamond.

33. The method according to claim 32, wherein acid-leaching comprises $FeCl_3$ acid leaching.

34. The method according to claim 31, wherein forming at least one hole in the TSD body comprises forming the at least one hole during formation of the TSD body.

35. The method according to claim 31, wherein forming at least one hole in the TSD body comprises forming the at least one hole by electric discharge machining or by laser cutting the TSD body.

36. The method according to claim 1, wherein the pin is brazed into the at least one hole in the substrate, wherein the at least one hole in the substrate is a blind hole and wherein the at least one joining pin contains a joining pin hole located along a longitudinal axis and extending the full length of the pin, further comprising venting gasses produced during brazing through the joining pin hole.

37. The method according to claim 31, further comprising disposing a dampening material between the TSD body and the substrate.

38. The composite assembly according to claim 1, wherein the TSD body and the substrate further comprise interlocking surfaces.

39. The composite assembly according to claim 1, wherein the TSD body comprises a non-planar surface.

40. The composite assembly according to claim 13, wherein the TSD body and the substrate further comprise interlocking surfaces.

41. The composite assembly according to claim 13, wherein the TSD body comprises a non-planar surface.

42. The composite assembly according to claim 31, wherein the TSD body and the substrate further comprise interlocking surfaces.

43. The composite assembly according to claim 31, wherein the TSD body comprises a non-planar surface.

44. A composite assembly comprising:

a thermally stable diamond (TSD) body having a plurality of TSD body holes disposed therein, wherein the TSD body holes reach from a top surface of the TSD body to a bottom surface of the TSD body;

a substrate having a plurality of substrate holes disposed therein, the substrate holes located so as to align with the TSD body holes;

a plurality of joining pins disposed in the TSD body holes and the substrate holes to mechanically attach the TSD body to the substrate to form the composite assembly; and a brazing material, a welding material, or a glue connecting the substrate hole and the joining pin.

45. The composite assembly according to claim 44, wherein catalyst has been removed from the TSD body using acid leaching.

46. The composite assembly according to claim 45, wherein the catalyst has been removed from the TSD body using $FeCl_3$ acid leaching.

47. The composite assembly according to claim 44, wherein the substrate comprises a material selected from the group consisting of: tungsten (W), tungsten carbide (WC or $W_2C$), other carbide-containing materials, chromium (Cr), iron (Fe), nickel (Ni), and combinations thereof.

48. The composite assembly according to claim 47, wherein the substrate comprises cemented tungsten carbide.

49. The composite assembly according to claim 44, wherein the joining pins comprise a material selected from the group consisting of: tungsten (W), tungsten carbide (WC or $W_2C$), other carbide-containing materials, chromium (Cr), iron (Fe), nickel (Ni), and combinations thereof.

50. The composite assembly according to claim 49, wherein the joining pins comprise cemented tungsten carbide.

51. The composite assembly according to claim 44, wherein at least one of the substrate holes comprises a blind hole.

52. The composite assembly according to claim 44, wherein at least one of the joining pins contains a joining pin hole located along a longitudinal axis and extending the full length of the pin.

53. The composite assembly according to claim 44, wherein the TSD body further comprises at least one counter bore in which at least one of the joining pins is located.

54. The composite assembly according to claim 44, further comprising a dampening material located between the TSD body and the substrate.

55. The composite assembly according to claim 54, wherein the dampening material comprises a copper alloy, gold, or silver.

56. The composite assembly according to claim 44, wherein the TSD body and the substrate further comprise interlocking surfaces.

57. The composite assembly according to claim 44, wherein the TSD body comprises a non-planar surface.

58. A drill bit comprising:

a bit body; and a composite assembly comprising:

a thermally stable diamond (TSD) body having a plurality of TSD body holes disposed therein, wherein the TSD body holes reach from a top surface of the TSD body to a bottom surface of the TSD body;

a substrate having a plurality of substrate holes disposed therein, the substrate holes located so as to align with the TSD body holes;

a plurality of joining pins disposed in the TSD body holes and the substrate holes to mechanically attach the TSD body to the substrate to form the composite assembly; and a brazing material, a welding material, or a glue connecting the substrate hole and the joining pin.

59. The drill bit according to claim 58, wherein catalyst has been removed from the TSD body using acid leaching.

60. The composite assembly according to claim 59, wherein the catalyst has been removed from the TSD body using $FeCl_3$ acid leaching.

61. The drill bit according to claim 58, wherein the substrate comprises a material selected from the group consisting of: tungsten (W), tungsten carbide (WC or $W_2C$), other carbide-containing materials, chromium (Cr), iron (Fe), nickel (Ni), and combinations thereof.

62. The drill bit according to claim 61, wherein the substrate comprises cemented tungsten carbide.

63. The drill bit according to claim 58, wherein the joining pins comprise a material selected from the group consisting of: tungsten (W), tungsten carbide (WC or $W_2C$), other carbide-containing materials, chromium (Cr), iron (Fe), nickel (Ni), and combinations thereof.

64. The drill bit according to claim 63, wherein the joining pins comprise cemented tungsten carbide.

65. The drill bit according to claim 58, wherein at least one of the substrate holes comprises a blind hole.

66. The drill bit according to claim 58, wherein at least one of the joining pins contains a joining pin hole located along a longitudinal axis and extending the full length of the pin.

67. The drill bit according to claim 58, wherein the TSD body further comprises at least one counter bore in which at least one of the joining pins is located.

68. The drill bit according to claim 58, further comprising a dampening material located between the TSD body and the substrate.

69. The drill bit according to claim 68, wherein the dampening material comprises a copper alloy, gold, or silver.

70. The drill bit according to claim 58, wherein the composite assembly is in the form of a bearing.

71. The drill bit according to claim 58, wherein the composite assembly is in the form of a cutter.

72. The drill bit according to claim 71, wherein the bit body comprises a cutter pocket in which the substrate of the composite assembly is attached.

73. The drill bit according to claim 72, further comprising a brazing material, a welding material, or a gluing material attaching the substrate of the cutter to the cutter pocket.

74. The drill bit according to claim 71, wherein the substrate comprises a substrate cast directly in the bit body.

75. The drill bit according to claim 71, wherein the substrate comprises a substrate-like base case directly in the bit body.

76. The composite assembly according to claim 58, wherein the TSD body and the substrate further comprise interlocking surfaces.

77. The composite assembly according to claim 58, wherein the TSD body comprises a non-planar surface.

78. A method of forming a composite assembly comprising:

forming a plurality of holes in a thermally stable diamond (TSD) body, wherein the TSD body holes reach from a top surface of the TSD body to a bottom surface of the TSD body;

forming a plurality of holes in a substrate, the substrate holes located so as to align with the TSD body holes when the composite assembly is formed;

attaching a plurality of joining pins to the substrate via the substrate holes;

placing the joining pins in the TSD body holes and in the substrate holes and brazing, welding, gluing, or pressing the pins into the substrate holes to mechanically attach the TSD body to the substrate to form a composite assembly in which the TSD body and substrate are held together in the composite assembly in the absence of any non-mechanical attachment therebetween.

79. The method according to claim 78, further comprising forming the TSD body by acid-leaching catalyst from polycrystalline diamond.

80. The method according to claim 79, wherein acid-leaching comprises $FeCl_3$ acid leaching.

81. The method according to claim 78, wherein forming the plurality of holes in the TSD body comprises forming the TSD body holes during formation of the TSD body.

82. The method according to claim 78, wherein forming the plurality of holes in the TSD body comprises forming the TSD body holes by electric discharge machining or by laser cutting the TSD body.

83. The method according to claim 78, wherein at least one joining pin is brazed into at least one hole in the substrate, wherein the at least one hole in the substrate is a blind hole and wherein the at least one joining pin contains a joining pin hole located along a longitudinal axis and extending the full length of the pin, further comprising venting gasses produced during brazing through the joining pin hole.

84. The method according to claim 78, further comprising disposing a dampening material between the TSD body and the substrate.

85. The composite assembly according to claim 78, wherein the TSD body and the substrate further comprise interlocking surfaces.

86. The composite assembly according to claim 78, wherein the TSD body comprises a non-planar surface.

* * * * *